United States Patent [19]

McMills

[11] Patent Number: 4,583,811

[45] Date of Patent: Apr. 22, 1986

[54] MECHANICAL COUPLING ASSEMBLY FOR A COAXIAL CABLE AND METHOD OF USING SAME

[75] Inventor: Corey J. McMills, Los Altos, Calif.

[73] Assignee: Raychem Corporation, Menlo Park, Calif.

[21] Appl. No.: 594,628

[22] Filed: Mar. 29, 1984

Related U.S. Application Data

[63] Continuation-in-part of Ser. No. 480,052, Mar. 29, 1983, abandoned.

[51] Int. Cl.[4] ..... H01R 17/04

[52] U.S. Cl. ..... 339/177 R; 29/857; 174/89

[58] Field of Search ..... 339/177 R, 177 E; 174/89; 29/854, 857

[56] References Cited

U.S. PATENT DOCUMENTS

| | | | |
|---|---|---|---|
| 2,435,989 | 2/1948 | Webster | 339/177 R |
| 2,785,384 | 3/1957 | Wickesser | 339/177 R |
| 3,550,064 | 12/1970 | Caller et al. | 339/177 R |
| 3,551,882 | 12/1970 | O'Keefe | 174/89 |
| 3,634,815 | 1/1971 | Stevens | 339/177 E |
| 3,708,781 | 1/1973 | Trompeter | 339/177 R |
| 3,836,700 | 9/1974 | Niemeyer | 174/89 |
| 3,963,320 | 6/1976 | Spinner | 339/177 R |
| 4,156,554 | 5/1979 | Aujla | 174/89 |

FOREIGN PATENT DOCUMENTS

| | | | |
|---|---|---|---|
| 1065499 | 9/1959 | Fed. Rep. of Germany | 174/89 |

*Primary Examiner*—Neil Abrams

*Attorney, Agent, or Firm*—Dennis E. Kovach; Herbert G. Burkard

[57] ABSTRACT

A coupling assembly and a method of connecting and terminating coaxial cable is disclosed herein. The coupling assembly includes a connector body having a mating area for the cable, a driver, means for urging the driver and the body toward each other, a compressive member positioned between the connector body and driver which is deformable and which has sufficient compressive strength to deform the cable jacket. When the compressive member is deformed by the driver the compressive force from the member is focused by the connector body to deform the cable at the mating area and to provide an environmental seal and EMI seat between the cable and coupling assembly.

15 Claims, 4 Drawing Figures

MECHANICAL COUPLING ASSEMBLY FOR A COAXIAL CABLE AND METHOD OF USING SAME

PRIOR APPLICATION

This application is a continuation-in-part of application Ser. No. 480,052 filed Mar. 29, 1983, now abandoned, which is incorporated herein by reference.

FIELD OF INVENTION

This invention relates to a coaxial cable coupling assembly and a method of connecting the coupling to a coaxial cable. More particularly, this invention relates a mechanical coupling assembly which when assemblied provides environmental and EMI seal for the assemblied coupling and cable.

BACKGROUND OF THE INVENTION

Mechanical couplings have been used for a variety of applications. In particular, such couplings have been connected to (i.e. joined to, united to or linked with) various substrates including cables which have then been terminated or connected to other cables and the like. Such couplings have been used, for example, in connection with CATV cable. There are various types of CATV cables. It is particularly advantageous to use two particular types of cables with this invention. The first type of cable (Type-I) includes a center conductor surrounded by a dielectric, a rigid outer conductive wall defining a shielding means surrounding the dielectric and a protective jacket surrounding the outer wall. In some of the newer more flexible cables of this type, the protective jacket is polyethylene and is bonded to a thin outer wall such that the jacket cannot be removed or stripped from the outer wall without damaging the thin wall.

The second more flexible type of cable (Type-II) includes a center conductor surrounded by a layer of dielectric material, which is surrounded by an EMI foil shield, which is surrounded by an electrically conducting braid (also for EMI shielding purposes) and which is surrounded by a protective jacket. Quite often there are multiple layers of foil and braid.

A presently used typical coupling for Type-I cable is a threaded coupling having two outer members which are threaded to one another and sealed by means of an O-ring. The coupling also includes two inside members, each having a tapered inside surface. The inside members grip the wall deforming it to a smaller diameter such that a split ring between the inside members grips the wall at the deformed portion. O-rings are used to seal the inside and outside members.

A presently used typical coupling for Type-II cable includes a connector body having one end adapted for insertion in the cable between the EMI foil shield and the EMI braid. A narrow ring is positioned around the protective jacket adjacent the area of the cable to be connected to the coupling. A separate crimping tool is then positioned around the ring and crimped by applying pressure to the tool. The ring is distorted by the pressure and clamps down on the cable and connector body.

Certain disadvantages have been noted in using the typical coupling for Type-I cable. The typical Type-I coupling for such cable is craftsman-sensitive. Once the coupling has been installed on the cable, the coupling must be tightened to a predetermined torque level for good electrical properties between the coupled cable and a joint such as a connection with other cable or termination to a tap box or the like. If the connection between coupling and cable is overtightened and there are corrosive substances present stress cracking may result. Undertightening will cause poor EMI shielding and cable pull out under wind, ice or thermal loading conditions.

Additionally, typical Type-I and Type-II couplings are craftsman-sensitive because they require a portion of the protective jacket to be stripped back before connection with the cable. If the stripping operation is done incorrectly, portions of the electrical conductor or aluminum foil shield or braid shield may be lost and the cable's electrical properties damaged.

The stripping-back operation of both the Type-I and II cables destroys, inherently, some of each of the cable's environmental protection, i.e. the protective jacket at a particular crucial point, namely the connection or termination point of the cable. The stripping-back operation also slows down the craftsman. He must not only do the job, but he must do it with some degree of delicacy, so as not to destroy the cable's electrical properties or an unnecessary amount of its environmental protection.

Additionally, Type-II cables are often crimped incorrectly. The foil and braid are bunched together or destroyed, decreasing the EMI shielding properties of the cable.

Such cables are generally exposed to the harshest of outdoor environments at the connection or termination point. Such conditions include temperature changes of 100° F. or more within a 24 hour period. Additionally, the connection or termination must be able to withstand rain, ice, snow, extreme heat and cold, ultraviolet radiation, oxidation, pollution and salt spray without damage.

Additionally, the connection between the coupling, cable and termination or connection must be secure enough to prevent the wind from loosening same. The wind will cause vibration along the cable line and typically loosen the connection between coupling and cable and between coupling and the joint, such as termination or connection point.

The terminated or connected cable must be sealed so that it does not leak electromagnetic radiation, also known as electromagnetic interference (EMI) or radio frequency interference (RFI). Such EMI causes disruption of aircraft instruments, radar and the like and has become a deep concern for certain federal and state government agencies.

Typical Type-I and Type-II couplings fail to provide either adequate environmental seal or EMI seal. The result is that the coupling and/or termination and connection must be replaced quite frequently. Additionally, poor EMI shielding interferes with the electrical performance of aircraft instruments, radar and the like.

The tolerance limits for typical CATV cable are quite broad. For example, a typical ½" Type-I cable diameter varies from 0.493 to 0.507. A typical Type-II cable diameter varies from 0.234 to 0.250 for a RG59U cable. Typical couplings cannot presently handle such wide tolerance ranges.

A specific example of a typical Type-II coupling is disclosed in O'Keefe, U.S. Pat. No. 3,551,882 which is a crimp-type coupling for multiple outer conductor coaxial. A malleable ferrule is crimped down onto the inner braid to terminate it to the connector and an outer ferrule is then crimped down onto the outer braid directly over the inner ferrule to join it to the coupling. An example of a Type-I coupling is disclosed in Blanchard, U.S. Pat. No. 4,346,958 which uses O-rings to provide an environmental seal. Due to the broad tolerances of cable diameter, as mentioned above, it is difficult to achieve satisfactory seals with O-rings. Other examples of coaxial cable connectors are disclosed in Hyslop, U.S. Pat. No. 3,336,563 and in Hayward, U.S. Pat. No. 4,400,050.

Additionally, a heat-recoverable coaxial coupling assembly is disclosed in copending U.S. application Ser. No. 531,961 filed Sept. 14, 1983 for Type-I cable which includes a connector body having a mating area and a driver member made from heat-recoverable material surrounding the mating area. The cable jacket is positioned between the mating area and the driver member. The driver member is then heated to effect recovery. As the driver recovers it deforms the cable jacket at the mating area to prevent pullout of the cable and forms environmental and EMI seal. While quite effective at eliminating many of the above-described difficulties, such coupling assembly does require the use of heat. There are circumstances when heat, especially in the form of a flame, is undesirable.

SUMMARY OF THE INVENTION

The purpose of this invention is to provide a mechanical coupling assembly for coaxial cable having a center conductor surrounded by a dielectric layer which dielectric layer is surrounded by a layer or layers of conductive shielding and which shielding is surrounded by a protective outer jacket which environmentally seals the connection between coupling and cable. A further purpose of this invention is to provide a method for connecting the coupling to the cable for terminating and connecting such a cable such that the connection or termination is environmentally and electrically sealed.

To accomplish the purposes as set forth above and the object and advantages as set forth hereinafter, the instant invention includes a hollow connector body having a mating area for engaging the cable, a compressive member surrounding the mating area, the compressive member being deformable and having sufficient compressive strength to deform the shielding layer of the cable to be connected to the coupling. The coupling further includes a mechanical driver means compressive member for compressing the compressive member. Further means are included for urging the driver means and the connector body toward each other. Still further means are included for focusing the deformation of the compressive member to effect sealing of the coupling with the cable. Upon inserting the shielding layer or layers of a coaxial cable between the connector body and the compressive member and positioning the cable at the mating area and interconnecting the driver means to the connector body, the compressive member deforms the cable at the mating area and itself deforms filling voids between the substrate, connector body and driver means for providing an environmentally and electrically sealed connection.

A preferred embodiment of the device is particularly well-suited for Type-I cables and hollow elongate substrates with inflexible outer walls, generally. The preferred embodiment includes sizing means on the front end of the connector body for providing intimate contact between the rigid outer wall and the connector body over a wide tolerance range of such cables.

Another preferred feature of the coupling in accordance with the instant invention which is especially well-suited for Type-I cables is an anti-rotational means. The anti-rotational means is positioned at the mating area. After interconnection of the driver means and connector body, the rigid wall of the cables is deformed over the anti-rotational means to prevent the cable from turning relative to the coupling.

The preferred method of connecting a Type-I cable to the coupling includes removing or coring the dielectric between the outer wall and the center conductor over the length of the mating area. This ensures good electrical connection between the outer wall and the coupling.

A preferred embodiment of the coupling for either Type-I or Type-II cables includes the coupling having a stop means for preventing over interengagement or over- or under-tightening of the driver means to the connector body. The stop means for Type-I comprises the driver means having a rear face and the connector body having a front face. When driver means is fully interconnected with the connector body, the faces of each are flush, the coupling is fully sealed and further tightening is discouraged.

The coupling for Type-II cable includes a stop means wherein the driver means has a rear face which mates flushly with the front face of the tap box or other termination apparatus when the driver means is fully engaged.

It is an object of this invention to provide a mechanical coupling assembly which enviromentally and electrically seals the connected cable without the need of stripping the cable's protective jacket.

Other objects and advantages of the instant invention will be more fully understood in connection with the detailed description of the drawing as follows:

DESCRIPTION OF THE PREFERRED EMBODIMENT

The mechanical coupling assembly in accordance with this invention is especially well-suited for connection with two different types of electrical cable. A preferred embodiment, described in detail below, is especially well-suited for connection with a hollow rigid walled cable. An example of such a cable referred to below is a Type-I cable to which particular reference is made with respect to FIGS. 1 and 2 and is meant strictly for illustrative purposes only. Such a preferred embodiment may in fact be used for a variety of cables, including Type-II cable but it is especially well-suited for Type-I cable.

A second preferred embodiment is described in detail with reference to FIGS. 3 and 4. This second embodiment is especially well-suited for flexible cable, particularly Type-II cable. It should be understood that such a preferred coupling while especially well-suited for Type-II cables, may be used effectively for Type-I cables and other cables as well. The Type-II cable used in the detailed description below is meant for illustrative purposes only.

While both preferred embodiments of the invention include certain special features described in detail below, the basic elements of each are the same, namely (1) a connector body having a mating area for engaging an outer layer of a coaxial cable, (2) a driver means, (3) means for urging the driver means and connector body toward each other, (4) a deformable compressive member positioned between the driver means and connector body which is deformed when driver means and connector body are urged toward each other, and (5) means for focusing the deformation of the compressive member being deformed by the driver means and connector body. The term "outer layer" of a cable as used herein is intended to include any layer outside the dielectric area surrounding the center conductor. The mating area may be adapted to the positioned between outer layers of the cable. The mating area will normally engage an outer layer which is an EMI shielding layer of the cable.

Additionally, it should be understood that the Type-I and II cables are merely examples or subsets of a larger set where the generic cables include a center conductor surrounded by dielectric, a layer or layers of electrically conducting shielding surrounding the dielectric and a protective outer jacket surrounding and environmentally protecting the other elements of the cable.

Figure 1:
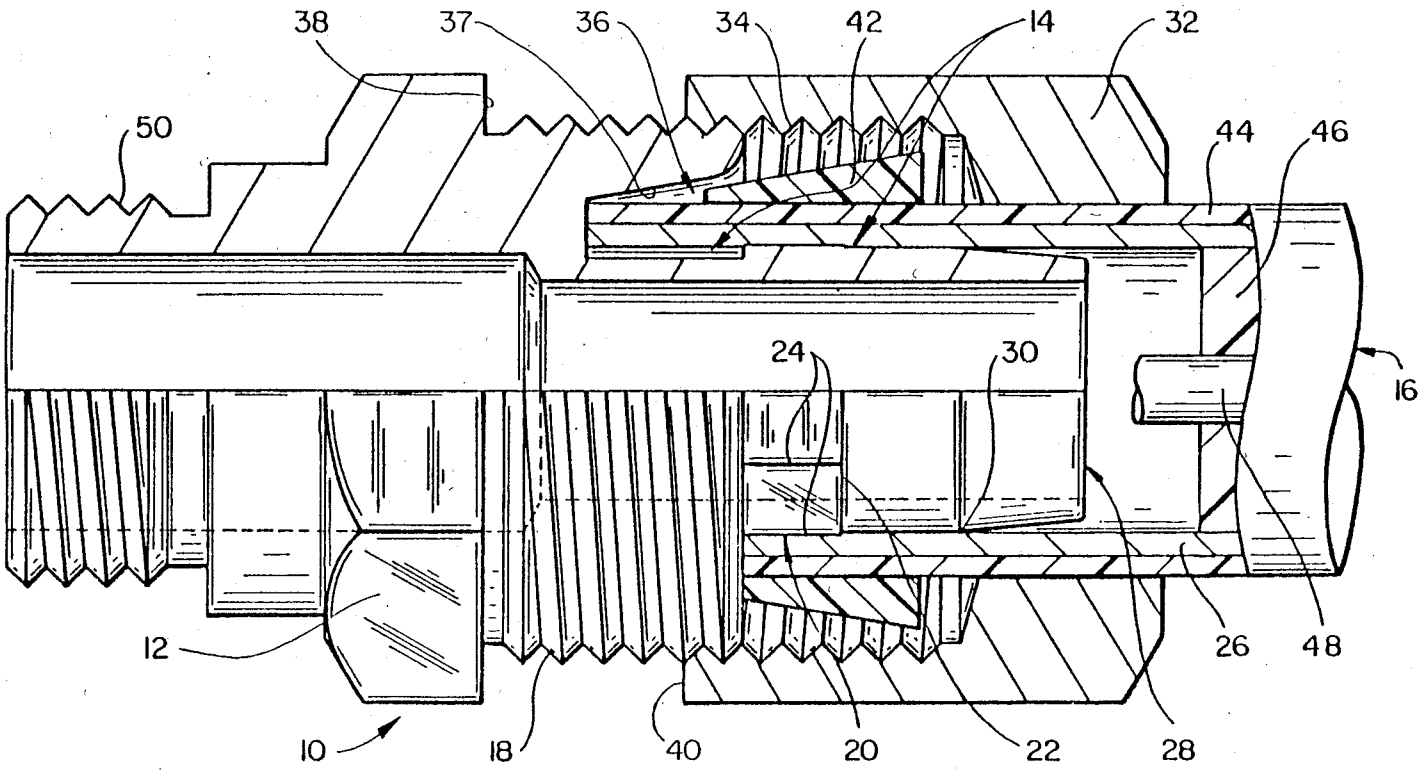
FIG. 1 is a partial cross-sectional view of the coupling in accordance with this invention prior to full interconnection of driver means and connector body.
Figure 2:
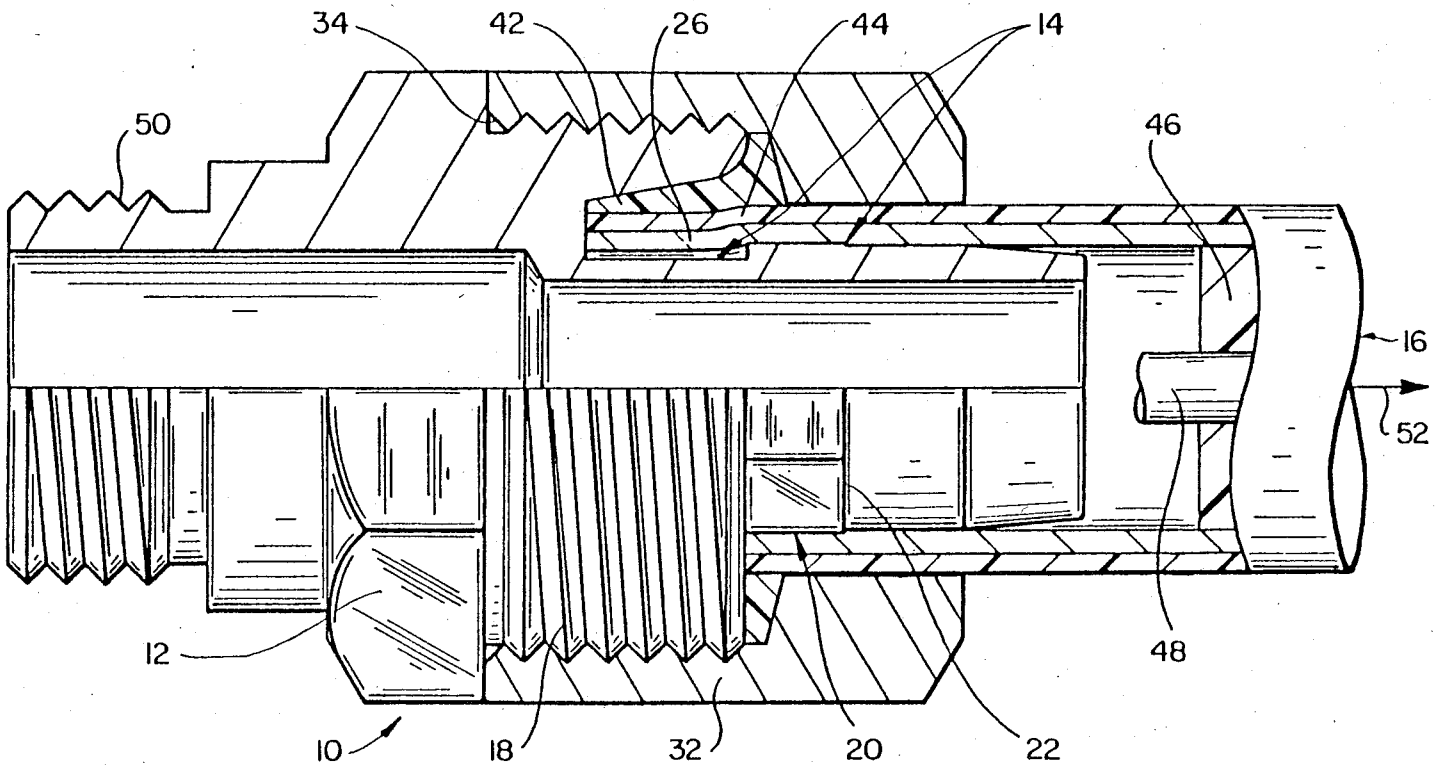
FIG. 2 is a partial cross-sectional view of the coupling of FIG. 1 after full interconnection of driver means and connector body.

With particular reference to the drawing, wherein like reference characters designate like or corresponding parts throughout the several views and referring particularly to FIGS. 1 and 2, there is seen the coupling of the instant invention designated generally by the numeral 10. The coupling includes a connector body 12.

The connector body 12 is generally cylindrical and hollow. The body 12 has a mating area generally designated by the numeral 14 for engaging the outer wall 26 of a Type-I coaxial cable 16. The body 12 includes a front outer threaded surface 18 which defines one element of the means for urging the connector body 12 and the driver means 32 toward each other.

The connector body 12 also includes a means 20 for preventing rotation of the cable with respect to the coupling, which comprises a hexagonal ring 22 having six edges 24 which penetrate the surface, only, of the outer wall or shielding layer 26 of cable 16. The coupling 10 is thus resistant to turning with respect to the cable as a result of wind and other like forces.

The connector body 12 further includes a cable sizing means 28. The shielding layer 26 is typically made from aluminum which, while being rigid, is malleable. The sizing means 28 comprises an enlarged head 30 having an outside diameter approximately the same as the largest anticipated inside diameter of the shielding layer 26 of cable 16. The connector body 12 with its sizing means 28 accommodates a wide range of cables while assuring good electrical and physical contact between coupling 10 and cable 16.

Preferably, the connector body 12 is made from the same material as the outer wall or shielding layer 26 of cable 16. Thus, in this example, connector body 12 is made from aluminum. This discourages corrosion and adds to the environmental and electrical sealing properties of coupling 10. If the shielding layer 26 were made from stainless steel, copper or other materials, the connector body 12 could be made to match.

The coupling 10 includes a driver means 32 which circumferentially surrounds and interconnects body 12 through threads 18 and 34. The driver 32 is hollow and generally cylindrical and is made from the same material as the body 12 for the same reasons stated above. Threads 18 and 34 comprise the means for urging body 12 and driver 32 toward each other. Upon initial interconnection as shown in FIG. 1, a void or space 36 is created between the driver 32 and body 12. As seen in FIG. 2, the volume of space 36 decreases as full interengagement of the driver 32 and body 12 is reached. The space 36 defines the means for focusing the deformation of the compressive member 42.

As set forth above, the coupling includes visual means for determining full engagement of driver 32 and body 12. The visual means comprises the body 12 having front face 38 and the driver 32 having a rear face 40. The body 12 and driver 32 are shaped and sized so that upon full interconnection of the body 12 and driver 32, the faces 38 and 40 are flush against one another. The field craftsman installing coupling 10 on cable 16 merely tightens the driver 32 to body 12 until the faces 38 and 40 are flush. If the craftsman overtightens the coupling 10, the force will be absorbed by the body 12 and driver 32 without damaging the cable 16.

The coupling further includes a compressive member 42 which surrounds the body 12 at the mating area 14. The compressive member contacts the cable 16 at least at the anti-rotational means after full inter-connection of the driver 32 and body 12. This secures the cable 16 at the edges 24 and prevents rotational movement of the cable 16 with respect to the body 12 as earlier described.

The compressive member 42 is deformable but has sufficient compressive strength to deform the cable 16 and in particular, the outer wall 26 with its protective jacket 44 thereon as shown in FIG. 2. As measured by the American Society for Testing and Materials method ASTM D 695, the compressive member 42 has a compressive strength of at least 2000 psi, and preferably between 2000 and 40,000 psi and most preferably 7100 psi. The material currently used which satisfies these conditions is polytetrafluoroethylene. Additionally, polyvinyl chloride, polyethylene, fluorinated ethylene-propylene copolymer, and aluminum 1100-0 are currently known to also possess the above characteristics.

The compressive member 42 provides a number of advantages, examples of which are the following. During assembly of the connector the compressive member 42 can grip the cable jacket and pull the cable into the connector during the final stage of assembly to assure good electrical connection. When used in the form of a ring, compressive member 42 can be split to facilitate fitting the ring over varying sizes of cables. The split then closes and a good seal is obtained upon assembly of the connector. Use of an appropriate material as the compressive member will allow a small portion of the material to extrude, under the pressure of the final stage of assembly, out between the cable jacket and the driver 32 to enhance the environmental seal and to provide visual indicator of proper assembly.

As previously mentioned, when the driver 32 and body 12 are initially interconnected the space 36 is defined. The compressive member 42 surrounds the mating area 14 and is located in the space 36. The volume $V_1$ of compressive member 42, is such that upon full interconnection of driver 32 and body 12, that the volume $V_2$, equals $V_1$. In this example, the means for focusing the deformation of compressive member 42 is the angled surface 37 which focuses the forces from the deformation of compressive member 42 toward mating area 14 and deforms cable outer wall 26 and protective jacket 44 to form the desired environmental and electrical seals.

In use, the cable 16 is prepared for connection with coupling 10 by coring the cable 16 of dielectric material 46. The outer wall 26 is positioned to surround mating area 14 with the wall 26 intimately engaging anti-rotational means 20. The cable 16 includes a center conductor 48 which extends through the hollow body 12.

After positioning the cable as described above, the compressive member 42 is positioned over cable 16 to surround the jacket 44 at the mating area 14 and especially to surround the jacket 44 at anti-rotational means 20. The driver 32 is slipped over cable 16 and then interconnected with the connector body 12 by engaging threads 34 with the threads 18.

The driver 32 is tightened onto body 12. As the torquing operation proceeds, the compressive member 42 deforms and is compressed. The deformation and consequently the compression is focused by the combination of the body 12 and driver 32. As the volume of the space 36 decreases more compression is realized and a greater compressive force is focused against the cable 16. As can be seen clearly with reference to FIG. 2, the compressive force of the member 42 deformes the cable 16 and effectively locks cable 16 into position on the connector body 12.

The combination of the configuration of the compressive member 42 and the penetration of the edges 24 into the surface of the outer wall 26 discourages cable pull back. If an axial pull back force is exerted on the cable, for example in the direction of arrow 52, a normal force will be created against the combination of the driver 32 and compressive member 42. Since the wall 26 has been deformed a significant component of the axial force will be exerted against the normal force of the driver 32 and member 42, relieving some of the strain of cable 16 and effectively discouraging cable pull back.

Since no stripping operation was necessary, the protective jacket 44 of the cable 16 fully covers the cable 16 after connection with coupling 10. The cable 16 retains all of its environmental protection. After full interconnection, the volume $V_1$ of the compressive member 42 equals the volume $V_2$ of the space 36. Since no void exists which can trap corrosive substances, the coupling 10 with connected cable 16 is also environmentally sealed.

It is especially important to have intimate contact between the connector body 12 and the outer wall shielding layer 26 as it discourages EMI leakage and effectively electrically seals the connected cable 16.

The connector body 12 is provided with threads 50 for connection with a compatible termination block, junction box, female connector for joining with another cable, or other components.

Figure 3:
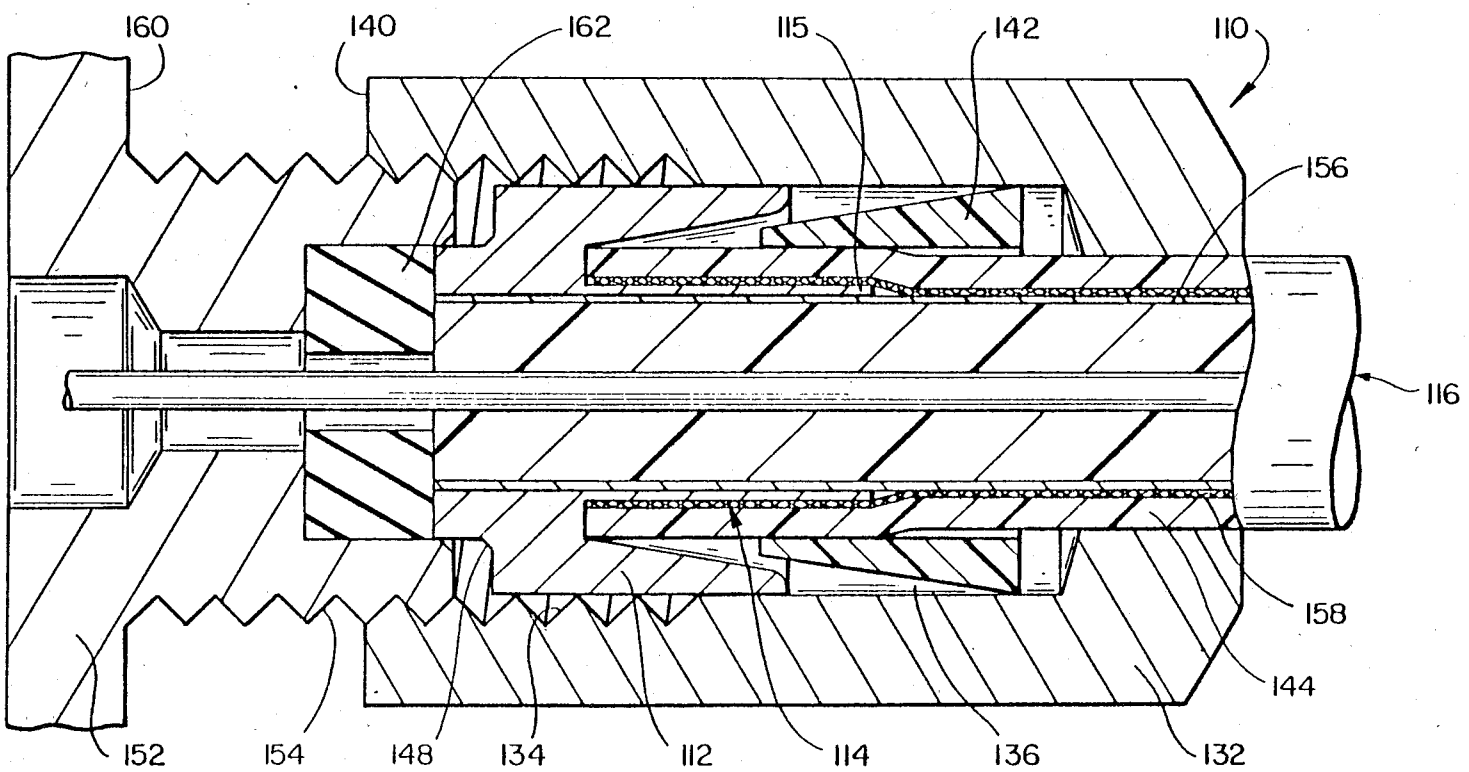
FIG. 3 is a full cross-sectional view of a coupling in accordance with this invention adapted for use with flexible coaxial cable and especially well-suited for Type II cable.
Figure 4:
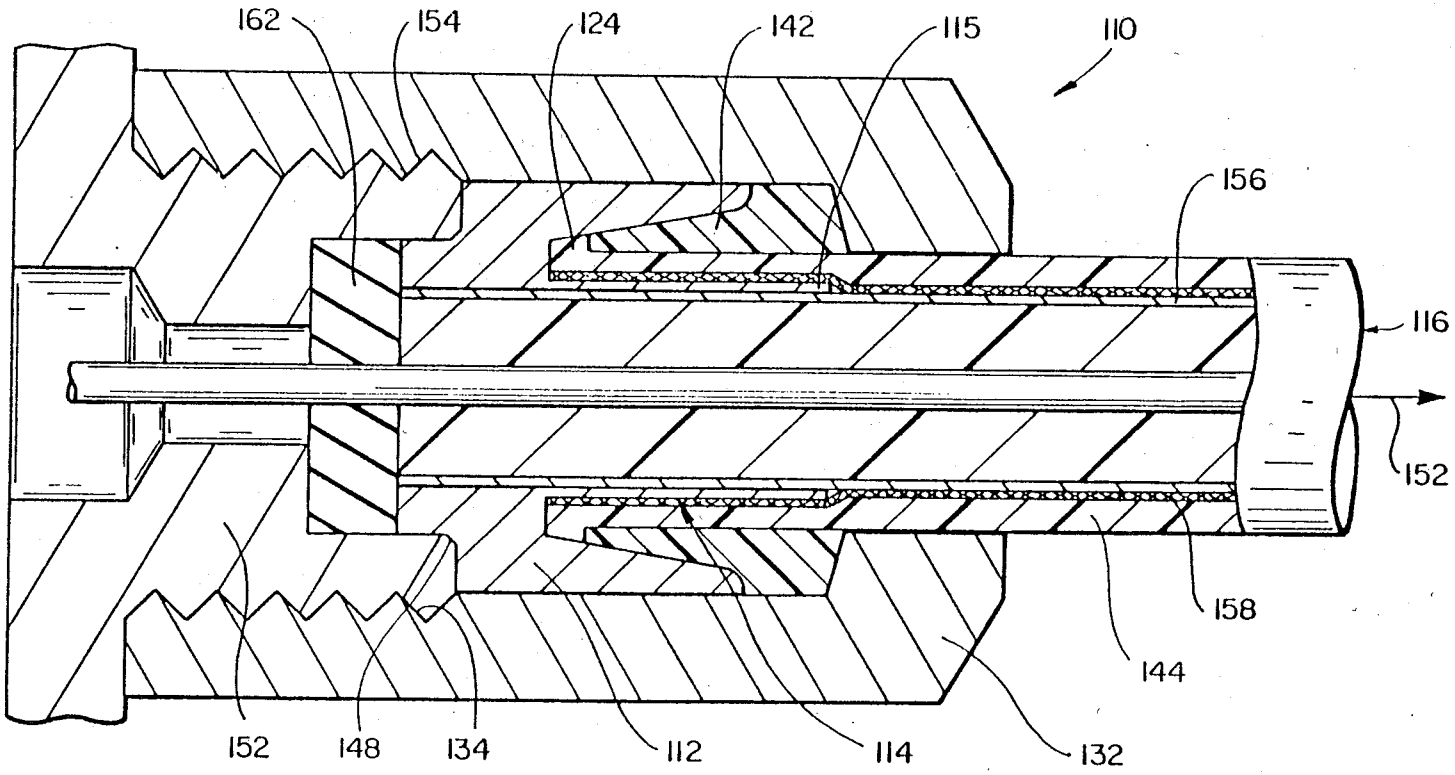
FIG. 4 is a full cross-sectional view of the coupling of FIG. 3 after full compression of the compression means by the driver means and connector body.

With particular reference to FIGS. 3 and 4 there is shown another preferred coupling 110 including the following elements, which function in the same manner as those described above except as set forth: a connector body 112 having a mating area 114, a driver means 132 having threads 134 and a rear face 140, and a compressive member 142.

The coupling assembly 110 is connected to a wall mounting unit 152 e.g., a tap box in FIG. 3 through threads 154 which is typical for Type-II cables illustrated by 116 in FIG. 3 and is commonly referred to as an "F-connector."

For this type of cable, it is necessary to separate the delicate foil shielding and braided layers, 156 and 158, respectively. The connector body 112 includes a mating area 114 for contacting the braided layer and a distal end 115 which is sharpened to wedge between the delicate foil 156 and braid 158. This sharpened elongated portion 115 of connector body 112 provides a visual means for the craftsman to assure that the braided layer is in fact separated from the foil shield and is being properly positioned on the exterior of portion 115 of connector body 112, i.e., on mating area 114, as the connector body 112 is being positioned on cable 116. This embodiment of the invention provides another visual inspection opportunity for the craftsman to assure proper separation of the foil shield 156 and braided layer 158 by extending the dielectric and foil past the end of connector body 112. After visual inspection to assure the foild shield is undamaged, the dielectric and foil can be cut off flush with the end of the connector body, leaving the center conductor extended as needed. Some Type-II cables have the foil shield bonded to the dielectric in an effort to assure the foil will remain intact during installation of a connector.

In use, the cable 116 is connected to the coupling assembly 110 by first connecting the cable 116 to the mating area 114. By providing appropriate pressure, this operation is done without damaging the cable and it electrically seals the cable.

The driver 132 and compressive member 142 are slipped over the cable prior to engaging distal end 115 into the cable. The driver 132 is then connected to wall unit 152 by threads 134 and 154, respectively, and thereby provides the means for urging connector body 112 and driver member 132 toward each other to deform compressive member 142. Similar to that set forth above with respect to FIGS. 1 and 2, a space 136 is created between the driver member 132 and connector body 112. The driver member 132 is tightened until its face 140 engages the face 160 of the wall unit 152. At that point, the volume of space 136 is slightly less than the volume of compressive member 142 to produce protuberance 124 in cable protective jacket 144 which also serves to lock cable 116 to the body 112.

The cable 116 remains environmentally sealed since stripping of its protective jacket outside the coupling 110 is not required. The coupling 110 is environmentally sealed through the use of the compressive member 142 and the flush fit of faces 140 and 160. Additionally, the coupling 110 is provided with a washer 162 which when compressed environmentally seals the connection between the coupling assembly 110 to the wall 152.

Additionally, coupling 110 is provided with a means for preventing cable pull-out, such as in response to a force in the direction of arrow 152. The means comprises protuberance 124 which works in a manner substantially identical to anti-rotation means 24 and which, as described above, was formed during connection by the volume difference between space 136 and member 142.

Connector body 112 is provided with a shoulder 148 to assure good electrical contact with wall unit 152 and provide maximum electrical continuity from the foil shield, braided layers and connector body 112 to wall unit 152. In some cases it may also be desirable to enhance the EMI shielding in the mating area 114 and between portion 115 of connector body 112 and foil shield 156 by providing sufficient focused force from deformation of compressive member 142 to not only deform the cable protective jacket 144 and braided layer 158 radially inward but to also deform portion 115 of connector body radially inward sufficient to maximize the electrical contact with the foil shield 156. This can be accomplished by adjusting the volume of compressive member 142 relative to space 136 and/or the shape of the outer part of the connector body 112 and the interior shape of driver member 132. Such optimization of this invention will be apparent to one skilled in the art who practices the various advantages provided by this invention.

The coupling assemblies of this invention form airtight connections with the cable. This provides a pressure seal which further serves to protect the cable and coupling from environmental damage. This invention is especially useful since it involves connecting the mechanical coupling assembly of the type described above without stripping off the protective outer jacket of the cable. The steps of the method include providing a coupling assembly of the type in accordance with the above, inserting the cable onto the connector body such that the outer conductor contacts the connector body at the mating area without stripping off the protective outer jacket, placing the compressive member to surround the cable at the mating area, placing the driver means to surround the compressive member, and urging the driver means and the connector body together and focusing the deformation of the compressive member such that it deforms the cable to the connector body thereby locking it in place and filling voids between the connector body and the driver means, thereby effecting a sealed electrical and environmental connection.

While the instant invention has been described by reference to what is believed to be the most practical embodiment, it is understood that the invention may embody other specific forms not departing from the spirit of the invention. The present embodiments, therefore, should be considered in all respects as illustrative and not limited to the details disclosed herein but are to be accorded the full scope of the claimed claims so as to embrace any and all equivalent apparatus, articles and methods.

I claim:

1. A connector for a coaxial cable having a center conductor and a substantially cylindrical outer layer surrounding the center conductor, comprising:

a deformable compressive member;

a connector body integrally formed of one piece of material and having a mating area disposed in contact with an outer layer of the coaxial cable, the connector body including means for focusing deformation of the compressive member, the mating area extending within the outer layer, the focusing means outwardly surrounding the outer layer and the deformable compressive member; and a driver member for compressing the deformable compressive member against the focusing means so as to compress at least part of the outer layer against the mating area.

2. The connector of claim 1, the outer layer comprising first and second outer EMI shield layers, the first and second EMI shield layers being separated by and being in electrical engagement with the mating area of the connector body.

3. The connector of claim 1, the mating area having a substantially uniform cylindrical cross-section profile extending from a short cylindrical wedge end thereof.

4. The connector of claim 2, the mating area having a substantially uniform cylindrical cross-section profile extending form a short cylindrical wedge end thereof.

5. The connector of claim 1, the mating area including anti-rotational means.

6. The connector of claim 2, the outer layer including a layer of dielectric material surrounding the center conductor and the first and second EMI shield layers surrounding the dielectric material.

7. The connector of claim 2, the first EMI shield layer being a thin smooth film layer, the second EMI shield layer being a braided layer, the outer cable layer further including a third layer, the third layer being a protective jacket material.

8. The connector of claim 7, the mating area being disposed between the first and second EMI shield layers with the focusing means surrounding the protective jacket material.

9. The connector of claim 3, the focusing means having a conical inner shaped profile and having an outer substantially uniform cylindrical shaped profile, the driver member having an inner substantially uniform cylindrical shaped profile, an inner diameter of the driver member being greater than an outer diameter of the connector body.

10. The connector of claim 9, the deformable compressive member having an outer conical shaped profile.

11. The connector of claim 1, the driver member having threads engageable with mating threads of a mounting unit.

12. The connector of claim 11, the driver member being axially movable by engaging the threads thereof with the threads of the mounting unit, and further comprising means for limiting axial movement of the connector body as the driver means is threadably moved axially thereto.

13. A kit of parts for connecting a coaxial cable to a mounting unit, comprising:

a deformable compressive member;

a connector body integrally formed of one piece of material and having a mating area disposed in contact with an outer layer of the coaxial cable, the connector body including means for focusing deformation of the compressive member, the mating area extending within the outer layer, the focusing means outwardly surrounding the outer layer and the deformable compressive member; and a driver member for compressing the deformable compressive member against the focusing means so as to compress at least part of the outer layer against the mating area.

14. The kit of claim 13, the outer layer comprising first and second EMI shield layers, the first and second EMI shield layers being separated by and being in electrical engagement with the mating area of the connector body.

15. A method of connecting a coaxial cable having a center conductor surrounded by a layer of dielectric material surrounded by conductive shield formed of first and second shielding layers surrounded by a protective outer jacket, the coaxial cable being connected to a connector, comprising the steps of:

inserting a connector body, integrally formed of one piece of material and having a mating area, onto an end of the cable such that the mating area of the connector body separates said first and said second conductive shielding layers of the coaxial cable and such that means, formed integrally with the one piece body, for focusing deformation of a compressive member outwardly surrounds the protective outer jacket and one of the shielding layers;

disposing the compressive member within the focusing means;

disposing a driver member adjacent the compressive member; and urging the driver member towards the connector body and the compressive member whereby deformation of the compressive member is focused by the connector body such that it deforms the one shielding layer of the cable shield against the mating area of the connector body thereby locking the cable shield in place and whereby the compressive member deforms to fill voids between the connector body and the driver member thereby affecting an electrical and environmental sealed connection.

* * * * *